US010759018B2

(12) United States Patent
Rao

(10) Patent No.: US 10,759,018 B2
(45) Date of Patent: Sep. 1, 2020

(54) METHOD AND APPARATUS FOR MACHINING A COMPONENT

(71) Applicant: Sundaram-Clayton Limited, Chennai (IN)

(72) Inventor: Telikicherla Venkata Lakshmi Narasimha Rao, Chennai (IN)

(73) Assignee: Sundaram-Clayton Limited, Chennai (IN)

( * ) Notice: Subject to any disclaimer, the term of this patent is extended or adjusted under 35 U.S.C. 154(b) by 132 days.

(21) Appl. No.: 15/754,415

(22) PCT Filed: Aug. 24, 2016

(86) PCT No.: PCT/IN2016/050283

§ 371 (c)(1),
(2) Date: Feb. 22, 2018

(87) PCT Pub. No.: WO2017/033211

PCT Pub. Date: Mar. 2, 2017

(65) Prior Publication Data

US 2018/0250791 A1 Sep. 6, 2018

(30) Foreign Application Priority Data

Aug. 25, 2015 (IN) ..... 4471/CHE/2015

(51) Int. Cl.
*B24B 31/116* (2006.01)
*B24C 3/32* (2006.01)
(Continued)

(52) U.S. Cl.
CPC ..... *B24B 31/116* (2013.01); *B24B 31/006* (2013.01); *B24C 3/32* (2013.01);
(Continued)

(58) Field of Classification Search
CPC ... B24B 31/003; B24B 31/006; B24B 31/116; B24B 49/16; B24C 3/327; B24C 3/32
(Continued)

(56) References Cited

U.S. PATENT DOCUMENTS 3,039,234 A * 6/1962 Balman ..... B24B 31/116 451/36
3,521,412 A * 7/1970 McCarty ..... B24B 31/116 451/36

(Continued)

OTHER PUBLICATIONS

PCT Search Report for corresponding International Application No. PCT/IN2016/050283 dated Jan. 5, 2017, 3 pages.

(Continued)

*Primary Examiner* — Eileen P Morgan
(74) *Attorney, Agent, or Firm* — Lee & Hayes, P.C.

(57) ABSTRACT

The present subject matter relates to a method and an apparatus in the form of a machine system (1200) for machining a component (100) with an internal passage (115). In an aspect, the method comprises periodically injecting 5 abrasive slurry back and forth through the internal passage (115) at a pressure ranging from about 25 bar to about 35 bar. The abrasive slurry comprises a mixture of abrasive particles having a size in the range of about 40 μm to about 60 μm, and a slurry medium. The volume fraction of the abrasive particles in the slurry medium is about 40% to about 50%. Further, the injection of the abrasive 10 slurry is performed for a predefined number of process cycles at predetermined time versus pressure changes to obtain the component having a final average surface roughness of less than about 3.0 μm.

19 Claims, 20 Drawing Sheets

(51) Int. Cl.
*B24B 31/00* (2006.01)
*B24B 49/04* (2006.01)

(52) U.S. Cl.
CPC ..... *B24C 3/327* (2013.01); *B24B 31/003* (2013.01); *B24B 49/04* (2013.01)

(58) Field of Classification Search
USPC ..... 451/36, 61, 113, 114
See application file for complete search history.

(56) References Cited

U.S. PATENT DOCUMENTS 3,634,973 A * 1/1972 McCarty ..... B24B 31/116 451/36
3,728,821 A * 4/1973 Perry ..... B24B 31/116 451/36
3,729,871 A * 5/1973 Taylor ..... B22D 29/00 451/104
3,823,514 A * 7/1974 Tsuchiya ..... B24B 31/116 451/36
4,936,057 A * 6/1990 Rhoades ..... B24B 31/116 451/113
4,996,796 A * 3/1991 Rhoades ..... B24B 31/116 451/114
5,070,652 A * 12/1991 Rhoades ..... B24B 31/116 451/104
5,076,027 A * 12/1991 Rhoades ..... B24B 31/116 451/114
5,788,558 A * 8/1998 Klein ..... B24B 31/116 451/113
6,086,455 A * 7/2000 Frantzen ..... A61F 2/91 451/36
6,500,050 B2 * 12/2002 Walch ..... B24B 31/116 451/113
6,905,395 B2 * 6/2005 Walch ..... B24B 49/16 451/113
6,953,387 B2 * 10/2005 Greenslet ..... B24B 31/116 451/36
7,380,557 B2 * 6/2008 Shiraishi ..... B08B 9/057 134/22.1
9,687,953 B2 * 6/2017 Sun ..... B24B 31/006
9,793,613 B2 * 10/2017 Wilson ..... H01P 11/002
10,065,289 B2 * 9/2018 Chinnakaruppan ..... B24C 3/327
2004/0266320 A1 * 12/2004 Walch ..... B24B 49/16 451/36
2017/0361418 A1 * 12/2017 Twelves ..... B24B 31/116
2018/0250791 A1 * 9/2018 Rao ..... B24B 31/116

OTHER PUBLICATIONS

PCT Written Opinion for corresponding International Application No. PCT/IN2016/050283 dated Jan. 5, 2017, 8 pages.

* cited by examiner

METHOD AND APPARATUS FOR MACHINING A COMPONENT

TECHNICAL FIELD

The subject matter described herein relates, in general, to machining components, and particular to a method and an apparatus for machining a component having an internal passage.

BACKGROUND

Abrasive flow machining (AFM) is a process of polishing or abrading a component, for example, a turbocharge compressor housing, by passing an abrasive medium having abrasive particles therein, under pressure, over the component surface to be machined or through an orifice extending into the component surface. The AFM is a technique has been applied over a wide range of applications. For example, the AFM technique is used for finishing of aerospace and medical components.

For example, in abrasive flow machining, the component may be connected to a dispensing system, which assists the flow of the abrasive medium through the orifice extending into the component surface, where the abrasive medium performs abrasion. The material which forms valleys on the surface of the of the component are ploughed by the abrasive particles present in the abrasive medium when the abrasive particles comes in contact with the material at high pressure. The ploughed material flows along with the abrasive medium in the direction of the motion of the abrasive particles. AFM is thus used to reduce the surface friction, and improve the finishing of the surface of the component.

BRIEF DESCRIPTION OF THE DRAWINGS

The detailed description is provided with reference to the accompanying figures. In the figures, the left-most digit(s) of a reference number identifies the figure in which the reference number first appears. The same numbers are used throughout the drawings to reference like features and components.

DETAILED DESCRIPTION

Figure 1A:
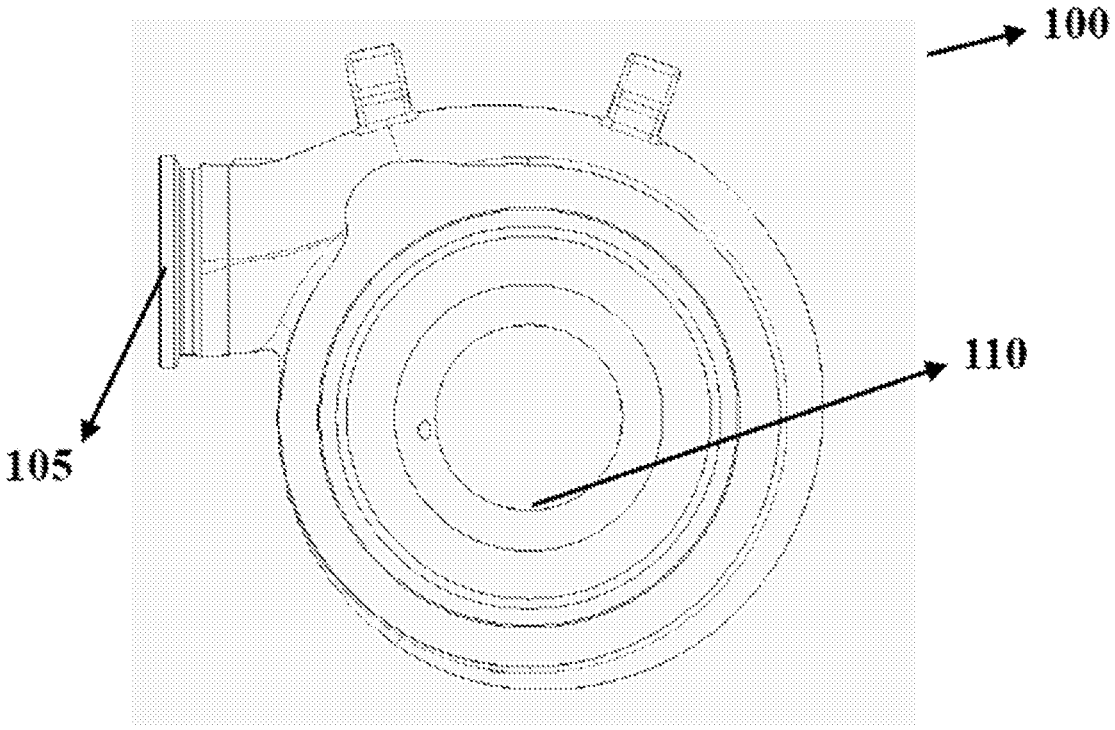
FIG. 1*a* illustrates a side view of an exemplary component to be machined, in accordance with an embodiment of the present subject matter.

The subject matter described herein relates to a method and an apparatus for machining an internal passage of a component, for example, irregularly shaped internal surface parts of the component that are inaccessible to conventional machining operations using surface finishing tools. An example of the component is turbocharger compressor housing, which is to be machined such that internal surface friction of the internal passage is substantially reduced. In one embodiment, the present subject matter relates to machining of the irregularly shaped internal passage of a turbocharger compressor housing made of aluminum alloy using an abrasive flow machine to obtain the turbocharger compressor housing having an average internal surface roughness of about less than 3 μm.

Generally, Abrasive flow machining (AFM) is used for processing the precision parts that have inaccessible surface areas to accomplish a very high amount of surface finish and accuracy. The advantage of the AFM lies in the ability to finish (debur, polish, and radius) complex internal passages or areas of the component that are inaccessible to other finishing methods such as mechanical honing.

In general, performance of the AFM is governed by different process parameters. The process parameters are broadly classified into three categories comprising machine settings or machine based parameters, abrasive media based parameters, and the configuration of the component to be machined. The machine based parameters include extrusion pressure, flow volume, media flow speed and number of process cycles or machining time. The abrasive media based parameters include viscosity of the abrasive media, rheology of the abrasive media, abrasive concentration in the abrasive media, abrasive grain size and shape, type of the abrasive media etc. Further, the component-based parameters include hardness of the component, length and area of the internal passage of the component, initial surface roughness, type of passage (cylindrical, rectangular or complex), etc.

The components like turbocharge compressor housing may be machined for better performance. Turbocharger compressors are well known devices for pressurizing intake air entering the combustion chambers of an internal combustion engine to thereby increase the efficiency and power output of the engine and also to reduce engine emissions. The fuel consumed by the engine in such cases depends on the performance of the turbocharger compressor.

Those skilled in the art have known that if an average internal surface roughness of the turbocharge compressor housing is reduced, then considerable saving in fuel costs can be realized. Conventionally, some techniques have been employed to reduce the average internal surface roughness of the irregularly shaped components. One such technique is described in U.S. Pat. No. 4,936,057 for machining a component made of steel. However, such techniques may not be employed for a component made of aluminum alloys, which are substantially softer than steel. As steel is hard and brittle, the peaks and valleys of the irregular shaped internal passage can be effectively removed from components made of steel. However, for components made of aluminum alloys, the peaks may be deformed when the abrasive media passes through the internal passage of the component, and the material may get sheared off later, for example, in use, which may be lead to additional problems.

Further, conventional casting techniques, for example, a Gravity Die Casting (GDC) technique may be employed to obtain the turbocharger compressor housing having a smoother surface. However, the average internal surface roughness obtained is about 4.5 μm to about 12.5 μm.

It is desirable and beneficial to further reduce the average internal surface roughness to a lower level to further reduce at least the fuel cost and engine emissions and to increase the efficiency and power output of the engine.

The present subject matter describes a method and an apparatus in the form of a machine system for machining an internal passage of a component, for example, turbocharger compressor housing. According to the present subject matter, an average surface roughness (Ra) of the internal passage of the turbocharge compressor housing is to be substantially reduced to less than 3 μm.

According to an embodiment of the present subject matter, the method for machining an internal passage, for example, irregular shaped internal passage, of turbocharger compressor housing comprises periodically injecting abrasive slurry back and forth through the irregularly shaped internal passage at a pressure ranging from about 25 bar to about 35 bar. The abrasive slurry comprises a mixture of abrasive particles having a size in the range of about 40 μm to about 60 μm, and a slurry medium. A volume fraction of the abrasive particles in the slurry medium is about 40% to about 50%. The method further comprises performing the injection for a predefined number of process cycles at predetermined time versus pressure changes to obtain the turbocharger compressor housing having a final average surface roughness of less than about 3.0 μm.

According to another embodiment of the present subject matter, an apparatus for machining the internal passage of a component, for example, the turbocharger compressor housing is described. The apparatus in the form of a machine system comprises a holder, for example, a mechanical jig, to hold the component. A first port of the component is connected to a first slurry chamber and a second port of the component is connected to a second slurry chamber. The apparatus in the form of the machine system further comprises a first cylinder and a second cylinder. The first cylinder is operationally connected to the first slurry chamber and disposed to enable pressurizing the first slurry chamber to enable pumping of the abrasive slurry through the first port of the component at a predetermined controlled pressure during a forward pumping cycle, this being a first half-cycle of the process cycle. The second cylinder is operationally connected to the second slurry chamber and disposed to enable pressurizing the second slurry chamber to enable pumping of the abrasive slurry through the second port of the component at the predetermined controlled pressure during a reverse pumping cycle, this being a second half-cycle of the process cycle. Further, the apparatus in the form of a machine system comprises a diaphragm fixture to regulate the flow of the abrasive slurry through the irregular shaped internal passage during the forward and reverse pumping of the abrasive slurry.

Figure 1B:
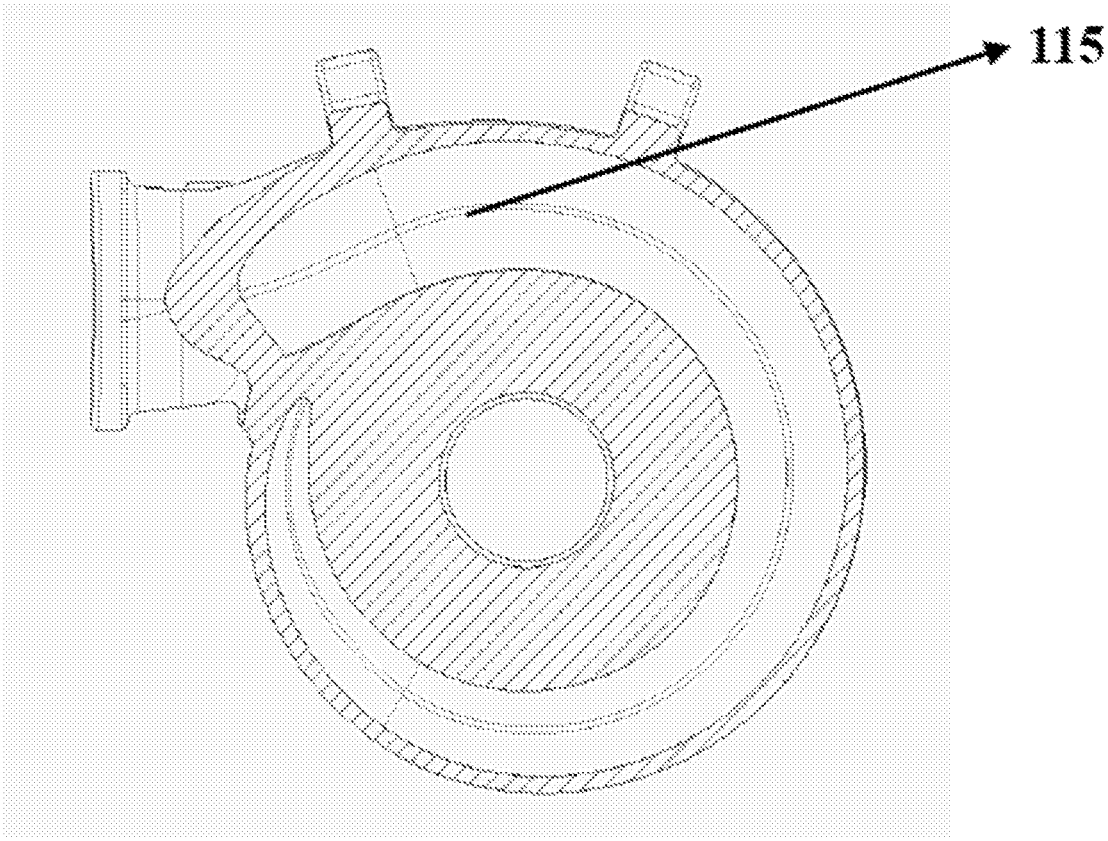
FIG. 1*b* illustrates a cross sectional view of the exemplary component of the FIG. 1*a*, in accordance with an embodiment of the present subject matter.

FIG. 1*a* illustrates a side view of an exemplary component to be machined, in accordance with an embodiment of the present subject matter. Although the present subject matter is described with respect to a turbocharger compressor housing 100, the present subject matter can be employed to any component, which has an internal passage, as shown in the FIG. 1*b*. The internal passage may be either regular shaped or irregular shaped. Although the present subject matter is described with respect to the irregular shaped internal passage, it is understood that the present subject matter can be implemented to the regular shaped internal passages as well. The turbocharger compressor housing 100 is shown in FIG. 1*a* and FIGS. 1*b* and 1*t* can be appreciated that it generally has a complex geometry. The turbocharger compressor housing 100 comprises at least two ports 105, 110 and an irregular shaped internal passage 115, which is a volute area of the turbocharger compressor housing 100. Hereinafter, the terms irregular shaped internal passage and volute area may be used interchangeably. In an embodiment, for machining the irregular shaped internal passage 115, abrasive slurry may be passed back and forth through the irregular shaped internal passage 115 from at least one port 105, 110 of the turbocharger compressor housing 100. A method of machining the turbocharger compressor housing 100 is described in detail with respect to FIG. 2, and an apparatus to implement the method is described in detail with respect to FIG. 12.

Figure 2:
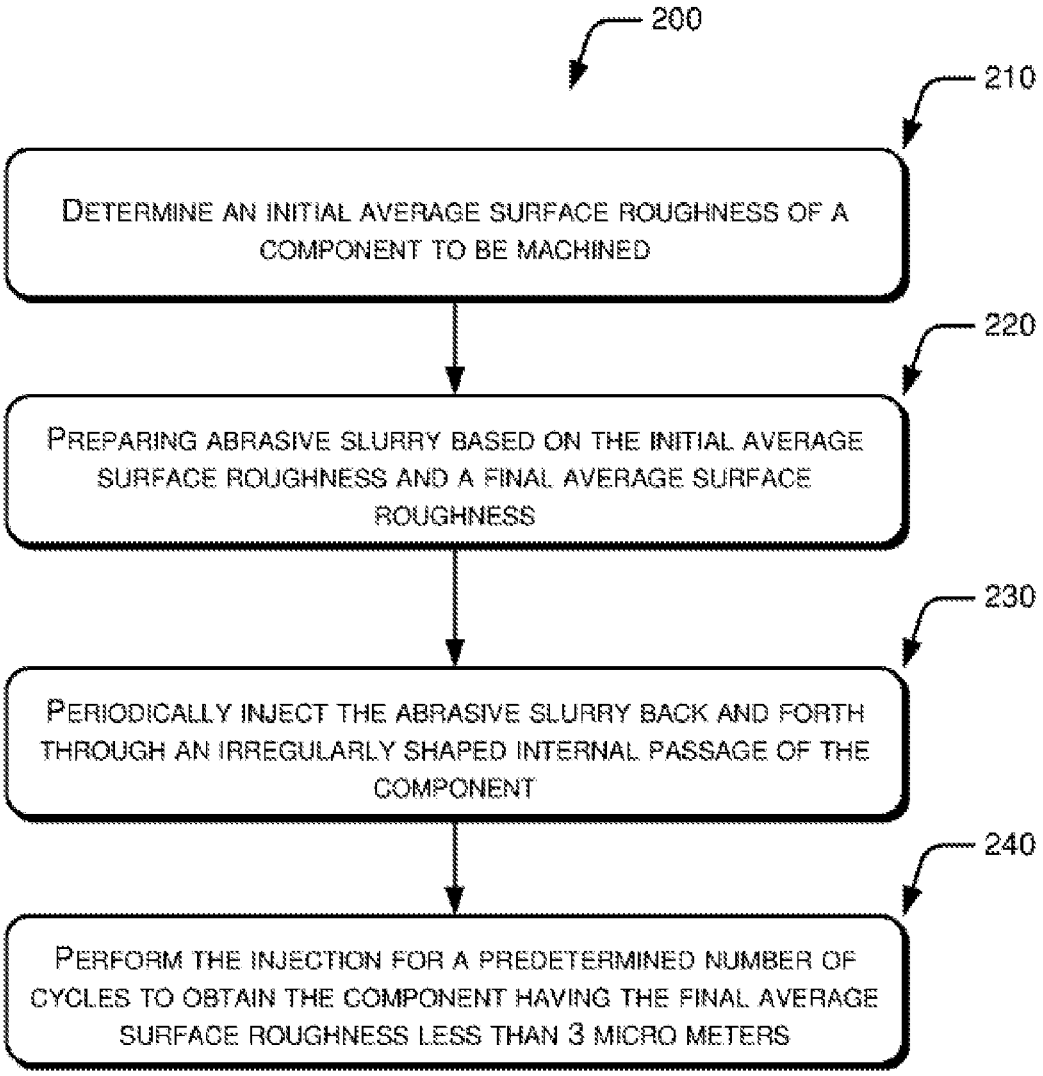
FIG. 2. shows a method of machining the component of the FIG. 1*a*, in accordance with an embodiment of the present subject matter.

FIG. 2. shows a method for machining the component of the FIG. 1*a*, in accordance with an embodiment of the present subject matter. The method 200 of the present subject matter is performed by an abrasive flow apparatus in the form of a machine system, which will be described in detail with respect to FIG. 12. The order in which the method blocks are described is not included to be construed as a limitation, and some of the described method blocks can be combined in any order to implement the method 200, or an alternative method. Additionally, some of the individual blocks may be deleted from the method 200 without departing from the scope of the subject matter described herein. Furthermore, some of the blocks of the method 200 can be implemented in any suitable hardware, software, firmware, or combination thereof.

At block 210, the method comprises determining an initial average surface roughness of the component, i.e., the turbocharger compressor housing 100. Specifically, the initial average surface roughness of the volute area 115 of the turbocharge compressor housing 100 is determined. One of conventional techniques or devices, for example, linear or areal roughness measurement technique, may be employed to determine the initial average surface roughness of the volute area 115 of the turbocharge compressor housing 100.

At block 220, upon determining the initial average surface roughness of the volute area 115, in an embodiment, the abrasive slurry may be prepared. Based on at least one of the initial average surface roughness and a desired final average surface roughness of the turbocharger compressor housing 100, the abrasive slurry is prepared by determining composition of the abrasive particles, and selecting a suitable slurry medium. For example, the composition is determined based on a look-up table, which may include different values of initial and final average surface roughness and the different compositions of the abrasive particles for each value of initial and final average surface roughness. Based on the desired final average surface roughness, corresponding composition of the abrasive particles may be determined and suitable slurry medium may be selected. In an example, a processor of a computer, for example, CNC machine, determines the composition of the abrasive particles. In another example, the composition of the abrasive particles and selection of the suitable abrasive medium may be performed manually.

In one example, the abrasive particles have a size in the range of about 40 μm to about 60 μm. The abrasive slurry may comprise a mixture of the abrasive particles as determined above and the slurry medium. Further, volume fraction of the abrasive particles in the slurry medium is about 40% to about 50%. The slurry medium may have characteristics from viscous flowing to semi-solid. In an embodiment, the slurry medium may have characteristics of semi-solid. In some embodiments, the slurry medium may have the consistency of putty. Further, the abrasive particles are selected from a group consisting of: aluminum oxide, boron carbide, silicon carbide, titanium carbide, and their like. In an embodiment, the composition can also contain multiple abrasive particles from the list above.

At block 230, the method comprises periodically injecting the abrasive slurry back and forth through the irregularly shaped internal passage 115 of the turbocharger compressor housing 100 at a pressure ranging from about 25 bar to about 35 bar. In another embodiment, the abrasive slurry is pumped back and forth through the volute area 115 at the pressure of about 35 bar. A pair of cylinders carries out the injection of the abrasive slurry back and forth through the irregularly shaped internal passage 115. One cylinder of the pair of cylinders pumps the abrasive slurry contained in a first slurry chamber to a second slurry chamber of an abrasive flow apparatus through the irregularly shaped internal passage 115. The other cylinder of the pair of cylinders pumps the abrasive slurry from the second slurry chamber to the first slurry chamber through the irregularly shaped internal passage 115, in the reverse flow.

Figure 3:
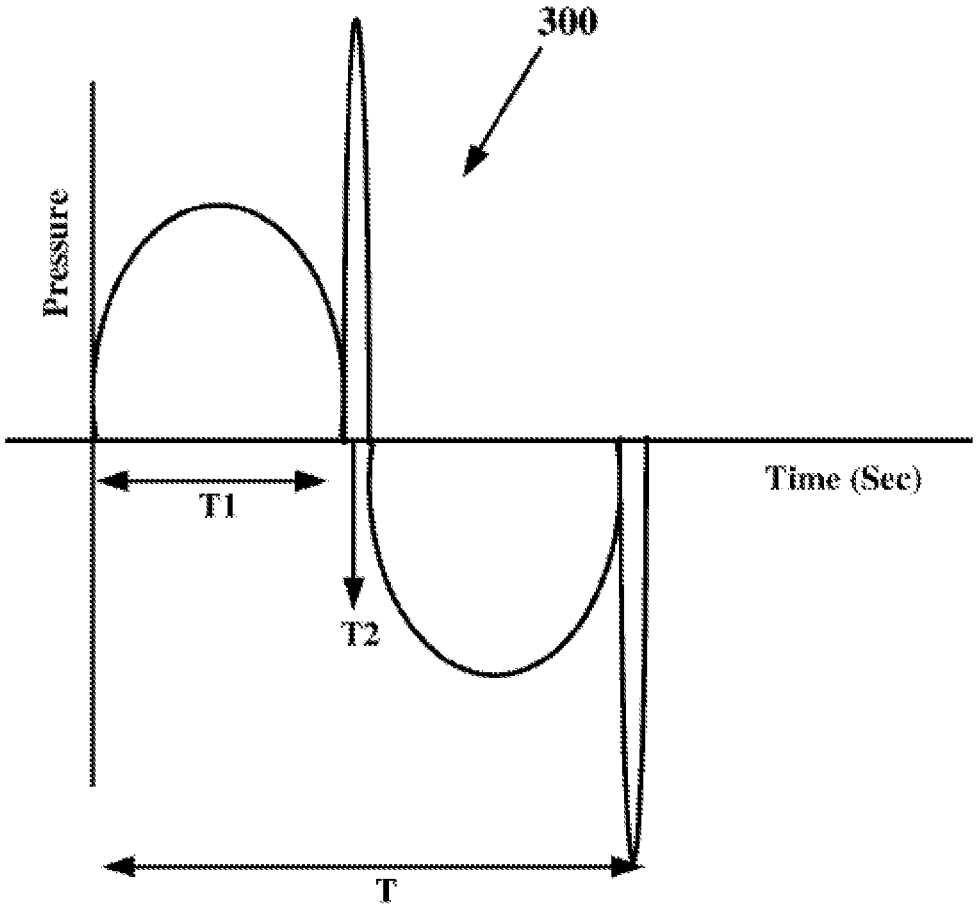
FIG. 3 shows a graph of an applied pressure for performing abrasive flow machining of the component during a process cycle, in accordance with an embodiment of the present subject matter.

At block 240, the method comprises performing the injection for predefined number of process cycles at predetermined time versus pressure changes until the turbocharger compressor housing 100 having a final average surface roughness of less than about 3.0 μm is obtained. In an embodiment, performing the injecting of the abrasive slurry back and forth for the predefined number of process cycles comprising applying the pressure in the form of one of: sinusoidal, triangular, and pulse, for a first predetermined time (T1) and applying an impulse pressure for a second predetermined time (T2) during each half-cycle of each process cycle, as shown in FIG. 3. In an aspect, the predefined number of process cycles is in a range from about 35 to 180. In an example, the predefined number of process cycles may be set manually by an operator using a user interface of the abrasive flow apparatus.

In an aspect, the predetermined time (T) is time taken for performing injecting the abrasive slurry from the first slurry chamber to the second slurry chamber through the irregularly shaped internal passage 115 during a forward movement of the abrasive slurry; and for injecting the abrasive slurry from the second slurry chamber to the first slurry chamber through the irregularly shaped internal passage 115 during a reverse movement of the abrasive slurry. In an aspect, the forward movement of the abrasive slurry forms a first half cycle of a process cycle and the reverse movement of the abrasive slurry forms a second half cycle of the process cycle.

FIG. 3 shows a graph of an applied pressure for performing abrasive flow machining of the component during a process cycle, in accordance with an embodiment of the present subject matter. Although the graph 300 shows the application of the pressure in the form of sinusoidal, it is understood that the pressure can be in the form of triangular, pulse, etc.

In an embodiment, the predetermined time (T) may be in the range from about 2 seconds to about 10 seconds. Further, the pressure may have a peak value in a range from about 20 bar to about 40 bar. Further, during the transition between the first half-cycle and second half-cycle of the abrasive slurry pumping, the impulse pressure is applied for the second predetermined time (T2). The impulse pressure has a peak value of about 1.4 to 1.5 times the peak value of pressure being applied during the first predetermined time (T1). For example, the first predetermined time (T1) is in the range from about 0.5 seconds to about 5 seconds, and the second predetermined time (T2) is in the range from about 50 microseconds to about 200 microseconds. For example, the first predetermined time (T1) and the second predetermined time (T2) may be set manually by an operator.

Without limitation, in an embodiment, combination of the process parameters including the pressure of 35 bar, grit size or abrasive particle size of 40 μm, and the volume fraction of about 50% by weight, are selected for machining the volute area 115 to obtain the final average surface roughness of less than about 3 μm.

In an embodiment, the final average surface roughness is improved with increasing pressure and volume fraction.

In another embodiment, the final average surface roughness is improved with increasing pressure and grit size.

In another embodiment, the final average surface roughness is improved with increasing volume fraction and grit size.

Further, in an embodiment, the process capability of the method 200 is calculated. It is observed that a process capability parameter ($C_{pk}$) of the method 200 has increased compared to the conventional methods. For example, the ($C_{pk}$) has increased from −0.68 to 1.57.

By employing the method 200 of the present subject matter, components like the turbocharger compressor housing 100 may be machined within 6 minutes to 10 minutes, while obtaining the average surface roughness of less than 3 μm.

An example Table 1 provided below shows the comparison of average surface roughness obtained for different samples of the turbocharger compressor housing 100 by employing the method 200.

TABLE 1

| Pressure(bar) | Grit Size (μm) | Volume fraction (%) | Number of samples | Hardness (BHN) | Initial Average Surface Roughness (μm) (Min~Max) | Final Average Surface Roughness (μm) (Min~Max) |
|---|---|---|---|---|---|---|
| 35 | 40 | 50 | 1 | 70.6 | 7.39~10.34 | 0.82~2.18 |
| | | | 2 | 77.8 | 7.5~8.33 | 1.31~2.82 |
| | | | 3 | 76.2 | 4.09~5.02 | 0.73~1.5 |
| | | | 4 | 71.6 | 8.98~10.07 | 1.01~2.91 |
| | | | 5 | 71.6 | 10.37~14.23 | 1.71~3.01 |
| | | | 6 | 69.6 | 7.27~9.98 | 0.63~1.41 |
| | | | 6 | 68.6 | 4.65~5.27 | 0.43~0.91 |
| | | | 8 | 69.1 | 6.07~8.76 | 0.49~2.1 |

From the above table 1, it is clear that the final average surface roughness of the irregular shaped internal passage 115 of the turbocharger compressor housing 100 is less then 3 μm. Thus, in accordance with the method 200, one or more process parameters comprising abrasive particle size, the volume fraction of the abrasive particles and the pressure may be varied to obtain the final average surface roughness of less than 3 μm.

Figure 4:
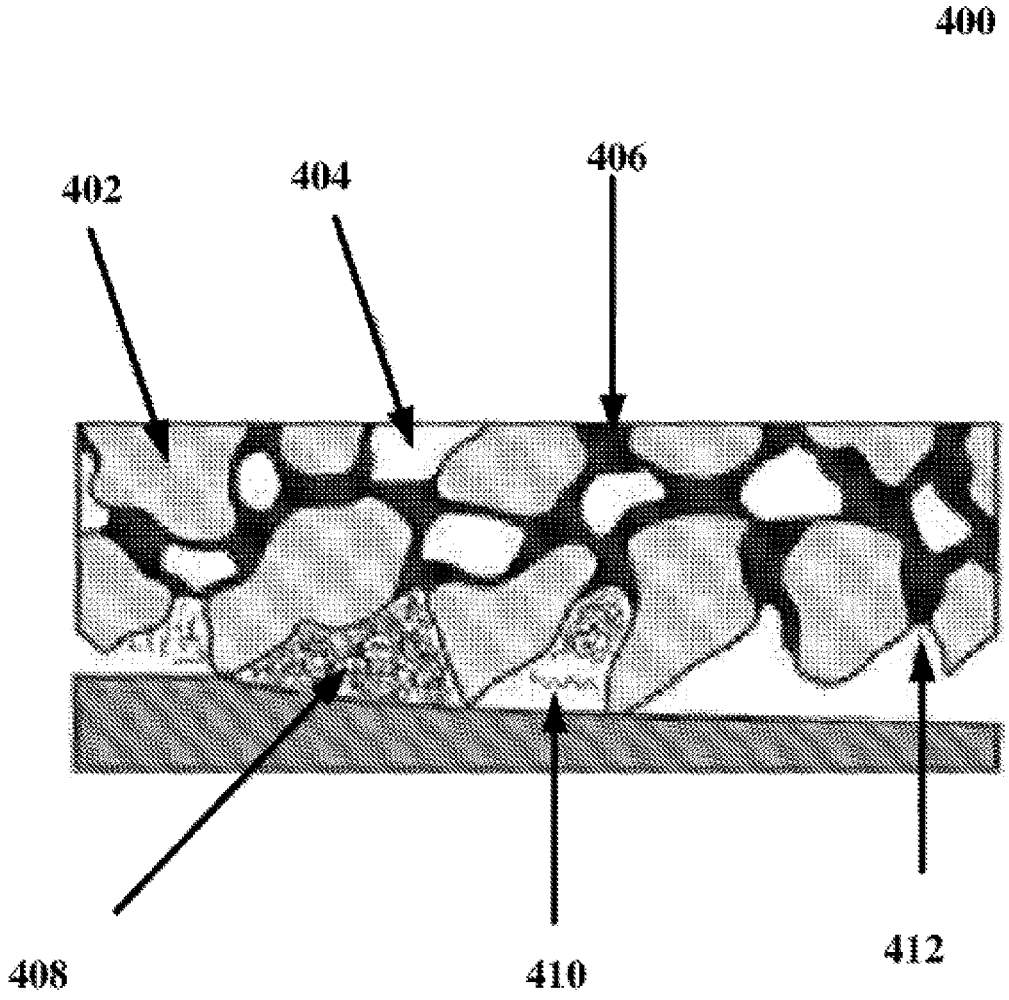
FIG. 4 illustrates an effect of volume fraction and size of abrasive particles, in accordance with an embodiment of the present subject matter.

FIG. 4 illustrates an effect of volume fraction of abrasive particles and size of abrasive particles, in accordance with an embodiment of the present subject matter. As previously mentioned, the abrasive slurry may have the abrasive particles 402 and the slurry medium 406. By maintaining the appropriate sized cavities 412 and voids 404, materials formed on the internal surface of the volute area 115 of the turbocharger compressor housing 100 may be ploughed without forming lips and shears. The cut materials 408 and 410 may be collected in a cavity of the abrasive flow machining apparatus.

Figure 5:
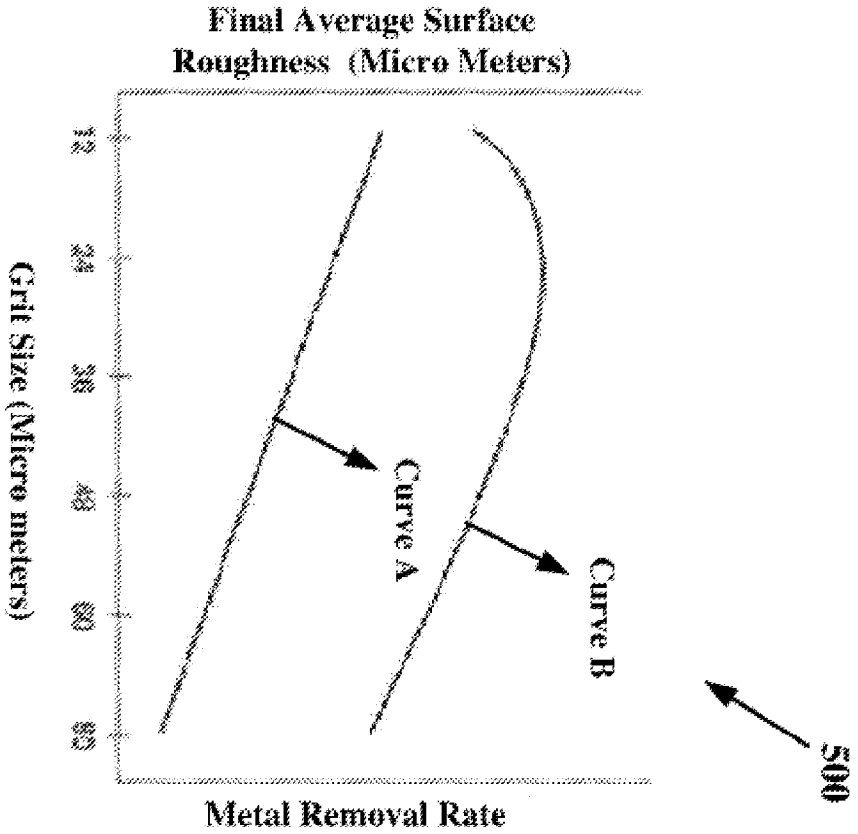
FIG. 5 shows a graph of a final average surface roughness and a metal removal rate versus grit size, in accordance with an embodiment of the present subject matter.

FIG. 5 shows a graph of a final average surface roughness and a metal removal rate versus grit size, in accordance with an embodiment of the present subject matter.

In the graph 500, curve A represents the variation of the final average surface roughness of the volute area of the turbocharger compressor housing 100 with respect to the size of abrasive particles, i.e., grit size. Further, curve B represents the variation of metal removal rate with respect to the grit size.

The results shown in the curve A and curve B are obtained by employing the method 200 of the present subject matter. From the curve A, it is understood that the final average surface roughness of the volute area of the turbocharger compressor housing 100 is reduced with increase in the grit size. From the curve B, it is understood that the metal removal rate is reduced with increase in the grit size.

Figure 6:
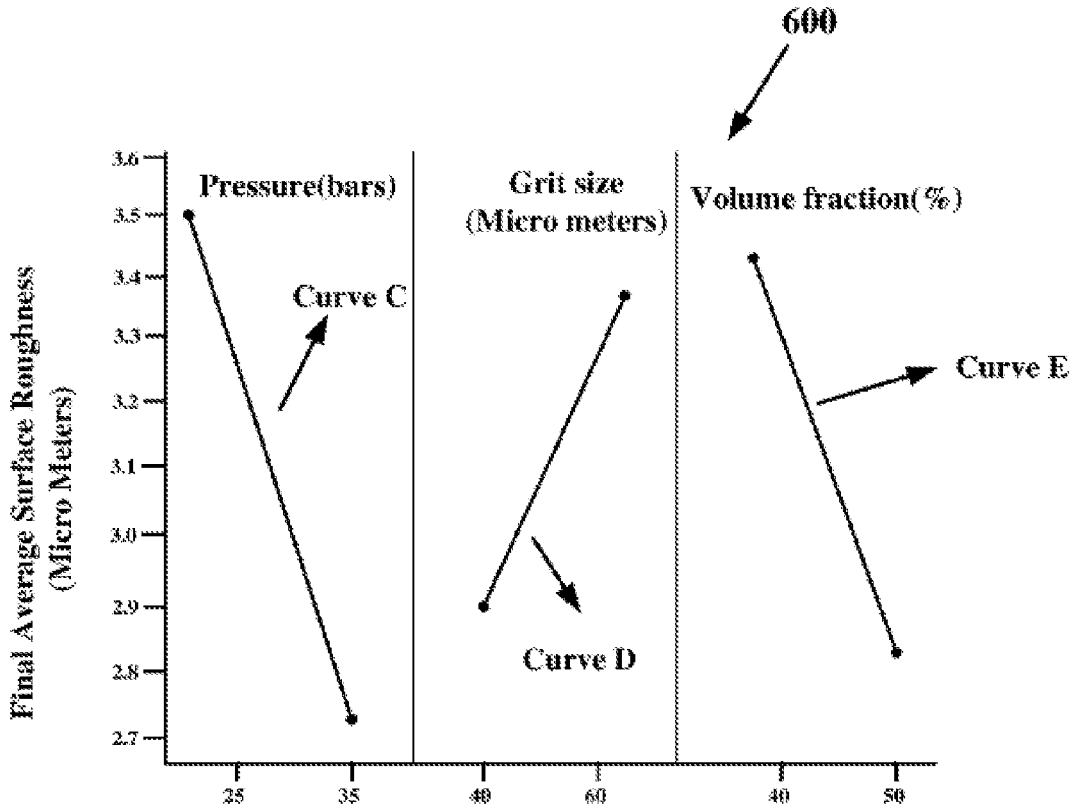
FIG. 6 shows variation of final average surface roughness of a volute area of turbocharger compressor housing with respect to different process parameters, in accordance with an embodiment of the present subject matter.

FIG. 6 shows variation of the final average surface roughness of the volute area of the turbocharger compressor housing with respect to different process parameters, in accordance with an embodiment of the present subject matter.

In the graph 600, curve C represents variation of the final average surface roughness of the volute area 115 with respect to a pressure that can be treated as an extrusion pressure at which the abrasive slurry is pumped back and forth through the volute area 115, since the slurry in many cases has very high viscosity and the pumping action is very close to a process of extrusion using the pumping pressure. From the curve C, it is understood that with increase in the extrusion pressure, the final average surface roughness of the volute area 115 has increased.

In the graph 600, curve D represents variation of the average surface roughness of the volute area 115 with respect to the grit size. With the increase in the size of the abrasive particles or the grit size, the average surface roughness of the volute area 115 of the turbocharger compressor housing 100 has reduced.

Further, curve E in the graph 600 represents the variation of the final average surface roughness of the volute area 115 with respect to the volume fraction of the abrasive particles in the slurry medium.

Figure 7:
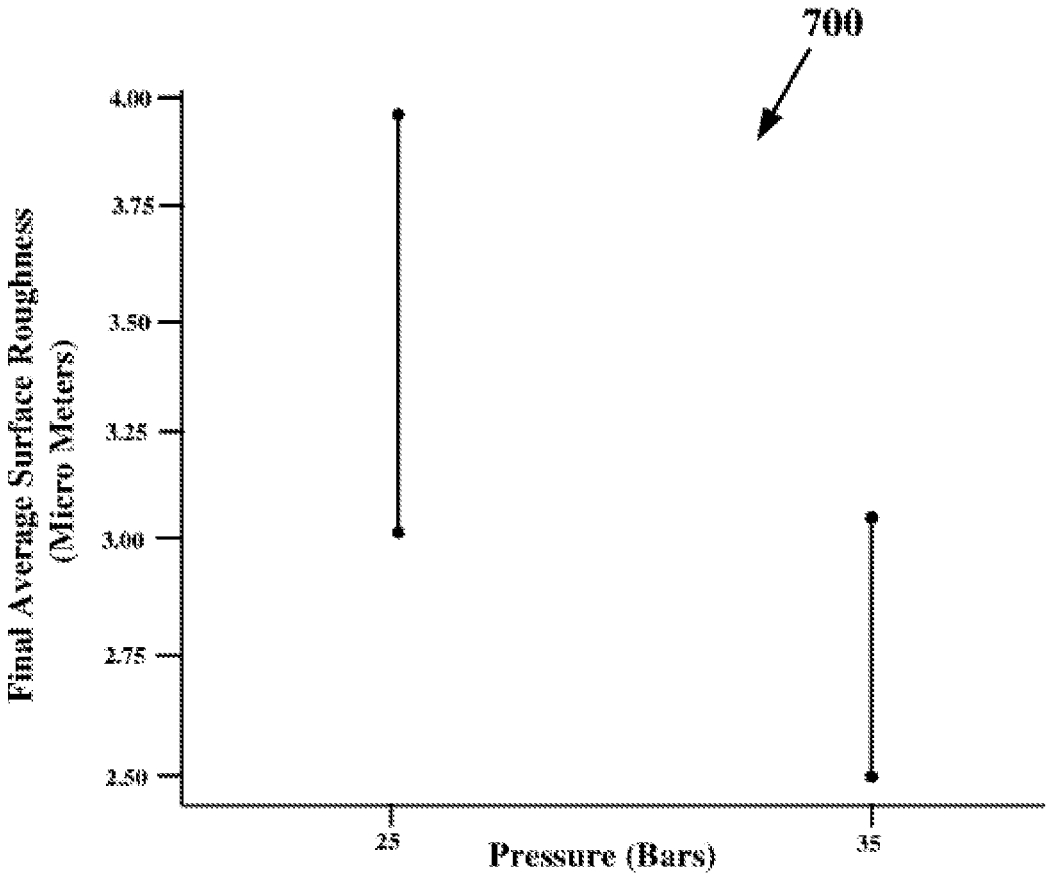
FIG. 7 shows an interval plot of the final average surface roughness of the volute area of the turbocharger compressor housing for different extrusion pressure values, in accordance with an embodiment of the present subject matter.

FIG. 7 shows an interval plot of a final average surface roughness of the volute area of the turbocharger compressor housing for different extrusion pressures, in accordance with an embodiment of the present subject matter. In the interval plot 700, variation of the final average surface roughness of the volute area 115 of the turbocharger compressor housing 100 for pressures of 25 bar and 35 bar is shown. It is understood that the final average surface roughness is less than 3 μm when the abrasive slurry is pumped at a pressure of 35 bar, and the final average surface roughness is greater than 3 μm when the abrasive slurry is pumped at a pressure of 25 bar.

Figure 8:
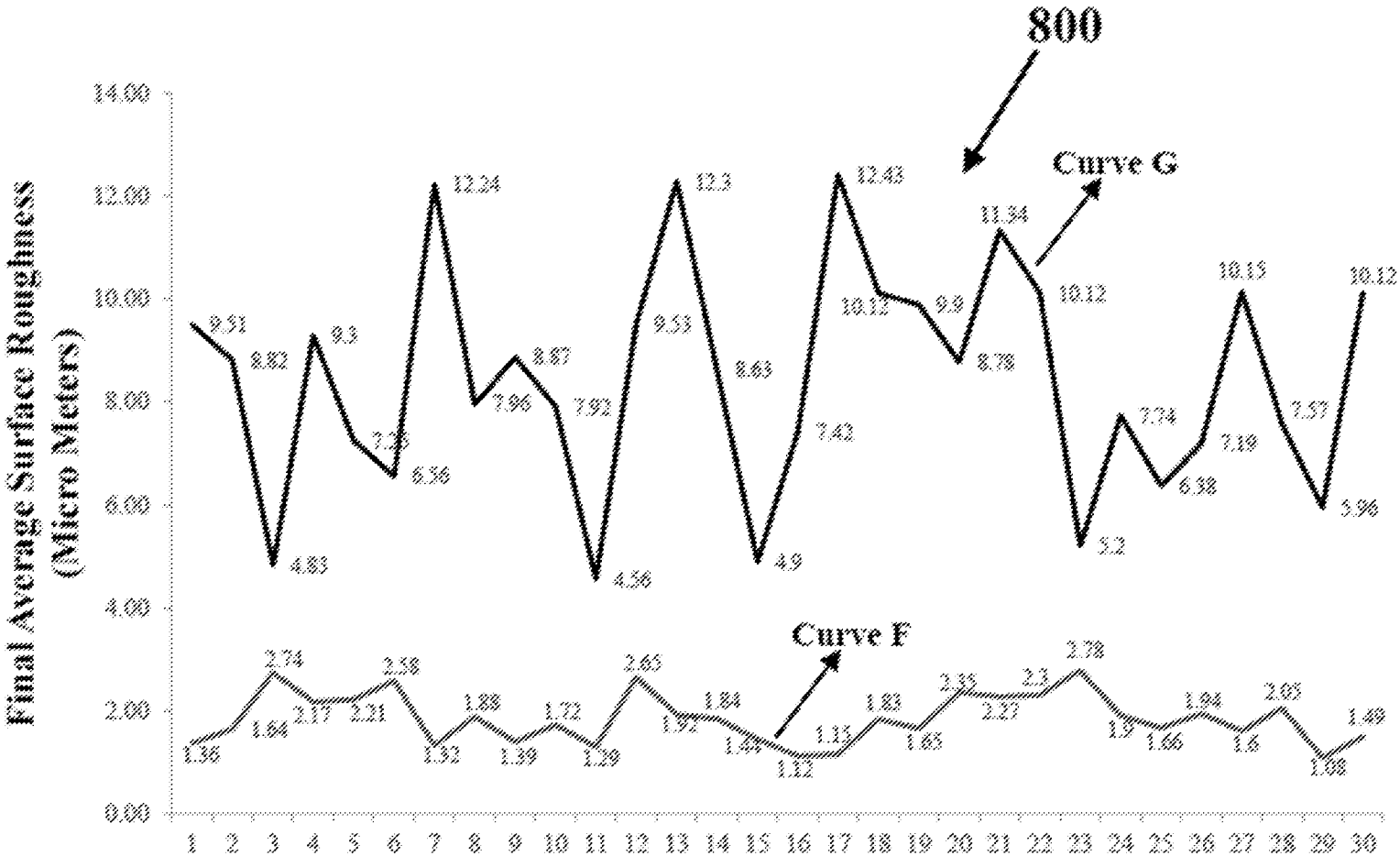
FIG. 8 shows a graph comparing the variation of the final average surface roughness of the volute area obtained by employing the method of FIG. 2 and a conventional technique, in accordance with an embodiment of the present subject matter.

FIG. 8 shows a graph comparing the variation of a final average surface roughness of different samples of the turbocharger compressor housing obtained by employing the method of FIG. 2 and a conventional technique, in accordance with an embodiment of the present subject matter. In the graph 800 of FIG. 8, curve F represents the variation of the final average surface roughness of the volute area 115 for different number of samples of the turbocharger compressor housing 100. Results shown in the curve G are obtained by employing a conventional technique, and the results shown in the curve F are obtained by employing the method 200. From the graph 800, it is understood that the method 200 of the present subject matter is capable of finishing the component to obtain the final average surface roughness of less than 3 μm.

Figure 9A:
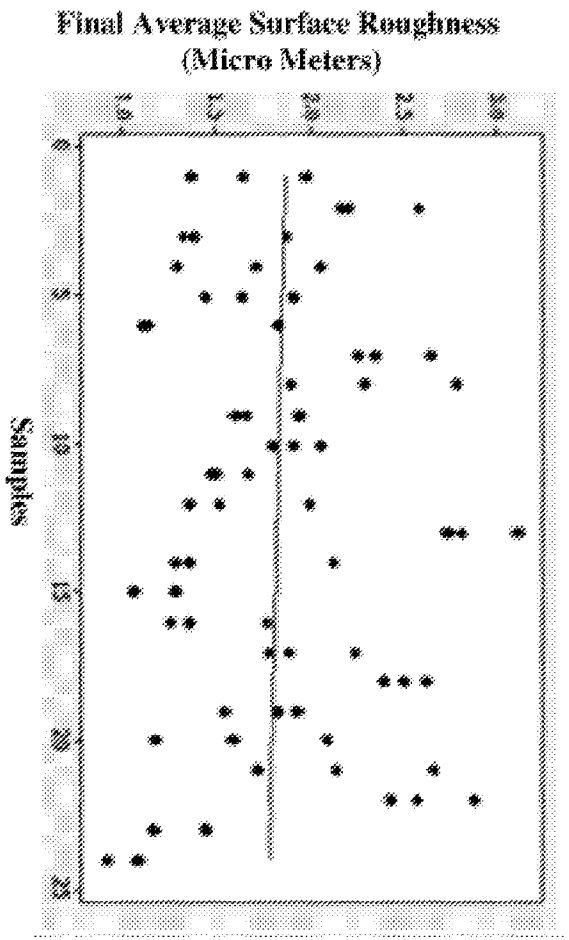
FIG. 9*a* to FIG. 9*d* show scatterplot, interval plot, Boxplot, and histogram of the final average surface roughness obtained for different samples of the turbocharger compressor housing by implementing the method 200, in accordance with an embodiment of the present subject matter.
Figure 9B:
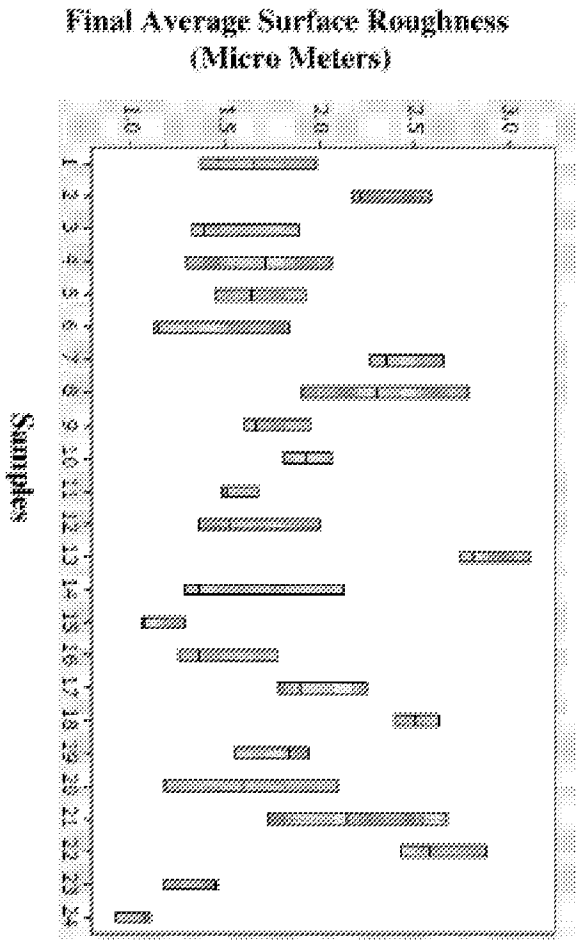
Figure 9C:
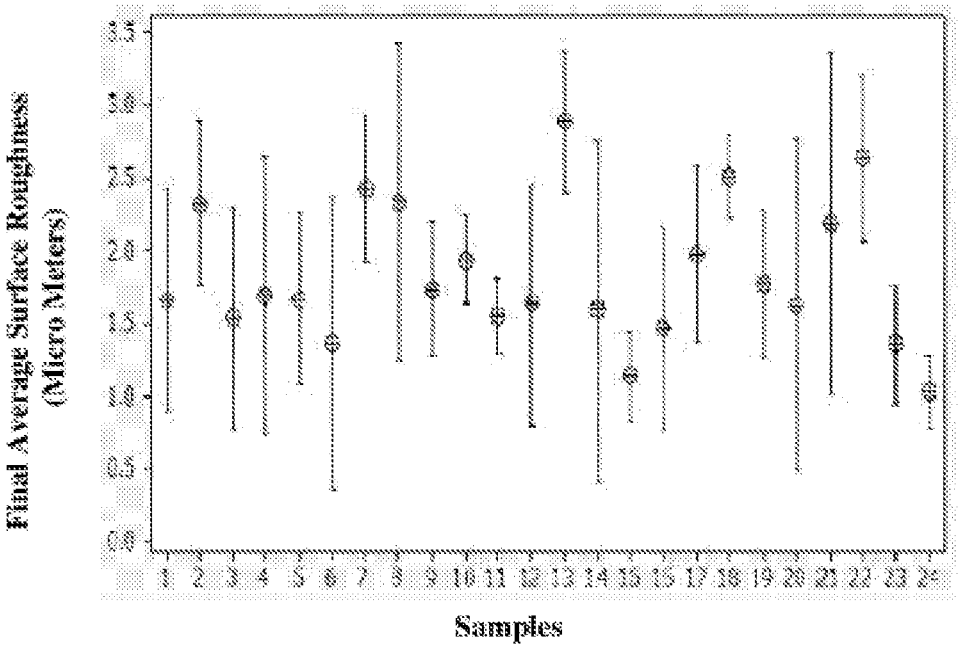
Figure 9D:
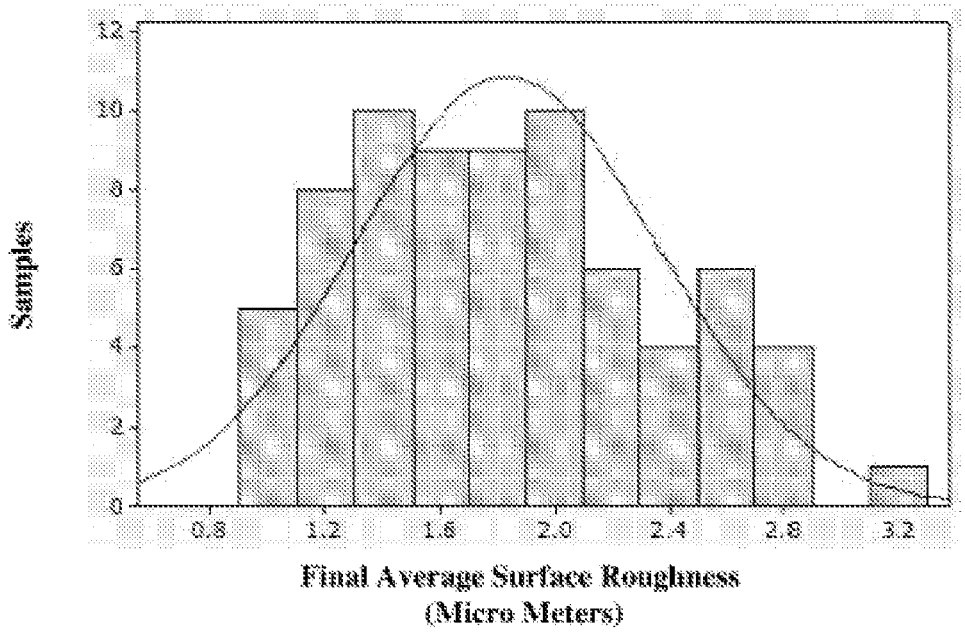

FIG. 9*a* to FIG. 9*d* show scatterplot, interval plot, Boxplot, and histogram of a final average surface roughness obtained for different samples of the turbocharger compressor housing by implementing the method 200, in accordance with an embodiment of the present subject matter. FIG. 9*a* is the scatterplot of the surface finish for different samples of the turbocharger compressor housing 100 obtained by employing the method 200. FIG. 9*b* is the boxplot of the surface finish for different samples of the turbocharger compressor housing 100 obtained by employing the method 200. FIG. 9*c* is the Interval plot of the surface finish for different samples of the turbocharger compressor housing 100 obtained by employing the method 200. FIG. 9*d* is the histogram of the surface finish for different samples of the turbocharger compressor housing 100 obtained by employing the method 200.

Figure 10:
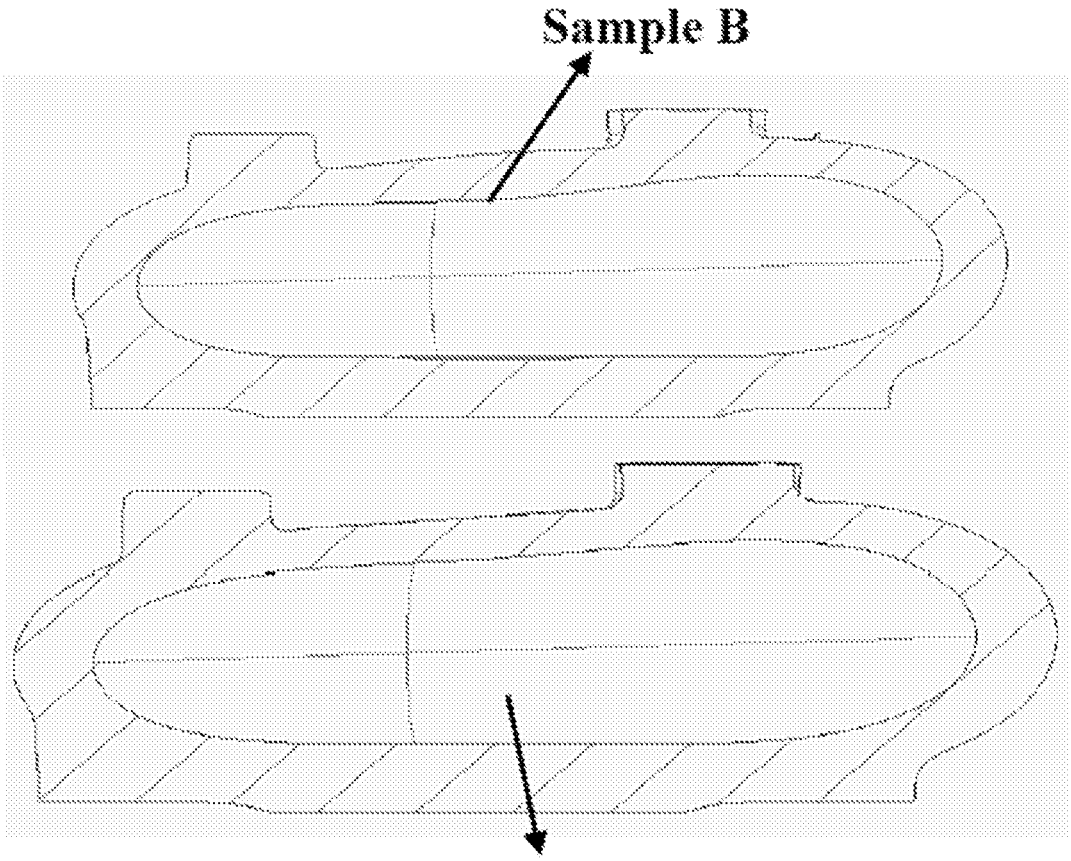
FIG. 10 shows cut sections of two different samples of volute area of the turbocharger compressor housing machined by the method 200 and by a conventional technique, in accordance with an embodiment of the present subject matter.

FIG. 10 shows cut sections of two different samples of volute area of the compressor housing machined by the method 200, and by a conventional technique, in accordance with an embodiment of the present subject matter. Sample A represents the cut section of the turbocharger compressor housing 100, where the sample A is obtained by employing the method 200. Sample B represents the cut section of the turbocharger compressor housing 100, where the sample B is obtained by employing the conventional technique. For the sample A, the final average surface roughness obtained is about 0.4 μm to 1.7 μmI, and for the sample B, the final average surface finish obtained is 6 μm to 12 μm. It is understood from the FIG. 10 that the sample A that is obtained by the method 200 is having a mirror like surface, which indicates that the quality of the surface finish of the sample A has improved compared to the sample B.

Figure 11A:
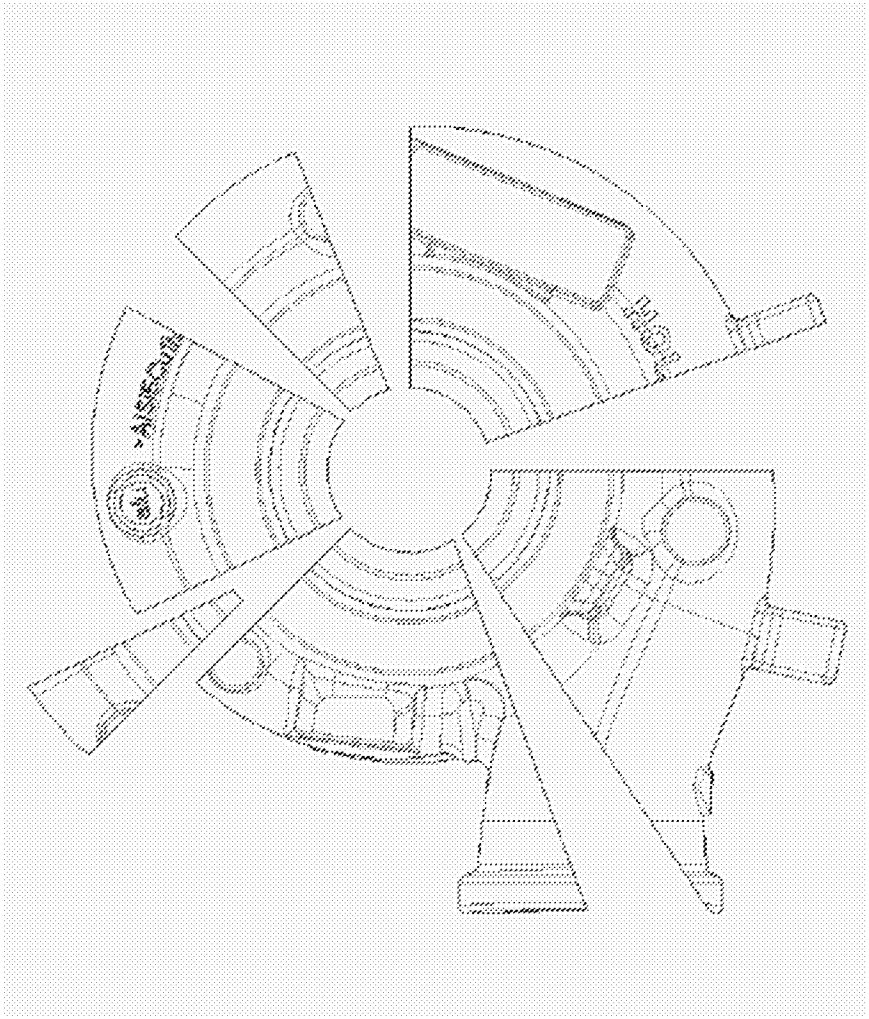
FIG. 11*a* and FIG. 11*b* show turbocharge compressor housings, which are cut as per a first cut scheme and a second cut scheme, respectively, in accordance with an embodiment of the present subject matter.
Figure 11B:
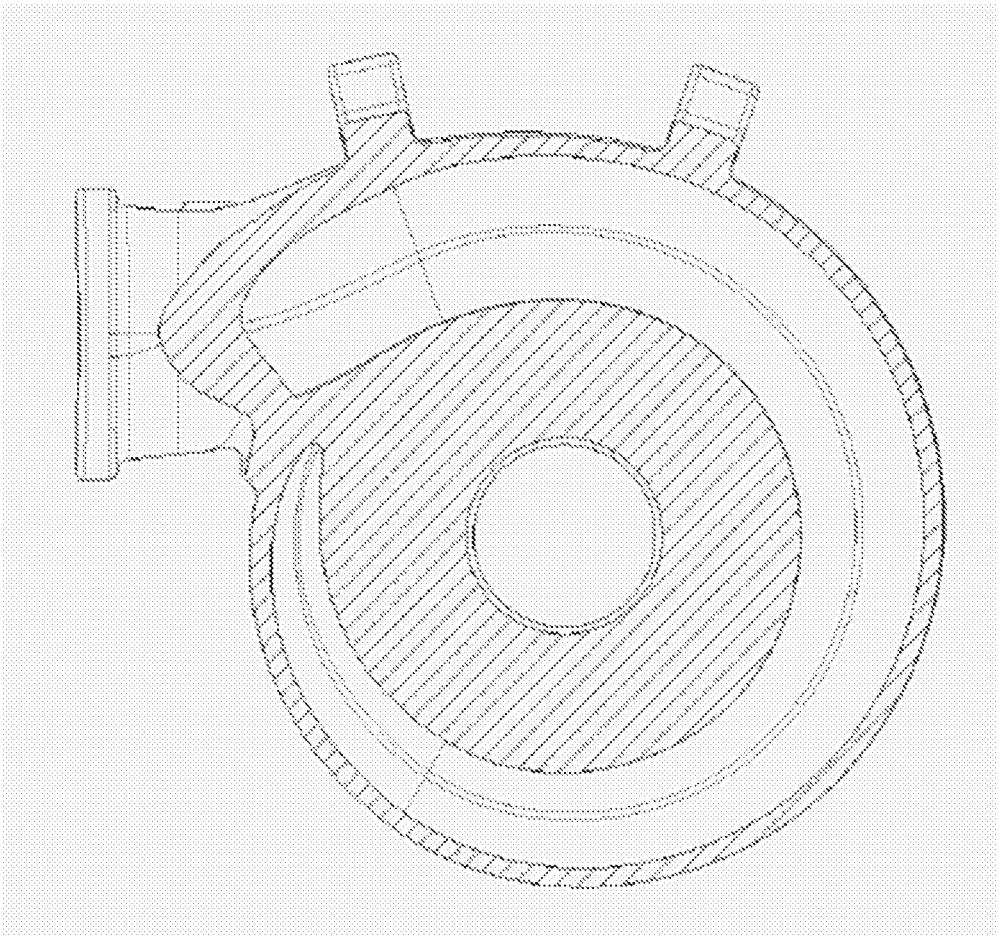

FIG. 11*a* and FIG. 11*b* show turbocharge compressor housings, which are cut as per a first cut scheme and a second cut scheme, in accordance with an embodiment of the present subject matter for measuring the surface roughness. In an embodiment, the turbocharge compressor housing 100 may be cut as per the first cut scheme shown in the FIG. 11*a* to measure surface finish of different cut sections of the turbocharger compressor housing 100. In another embodiment, the turbocharge compressor housing 100 may be cut as per the second cut scheme as shown in the FIG. 11*b* to measure the surface finish.

Figure 12:
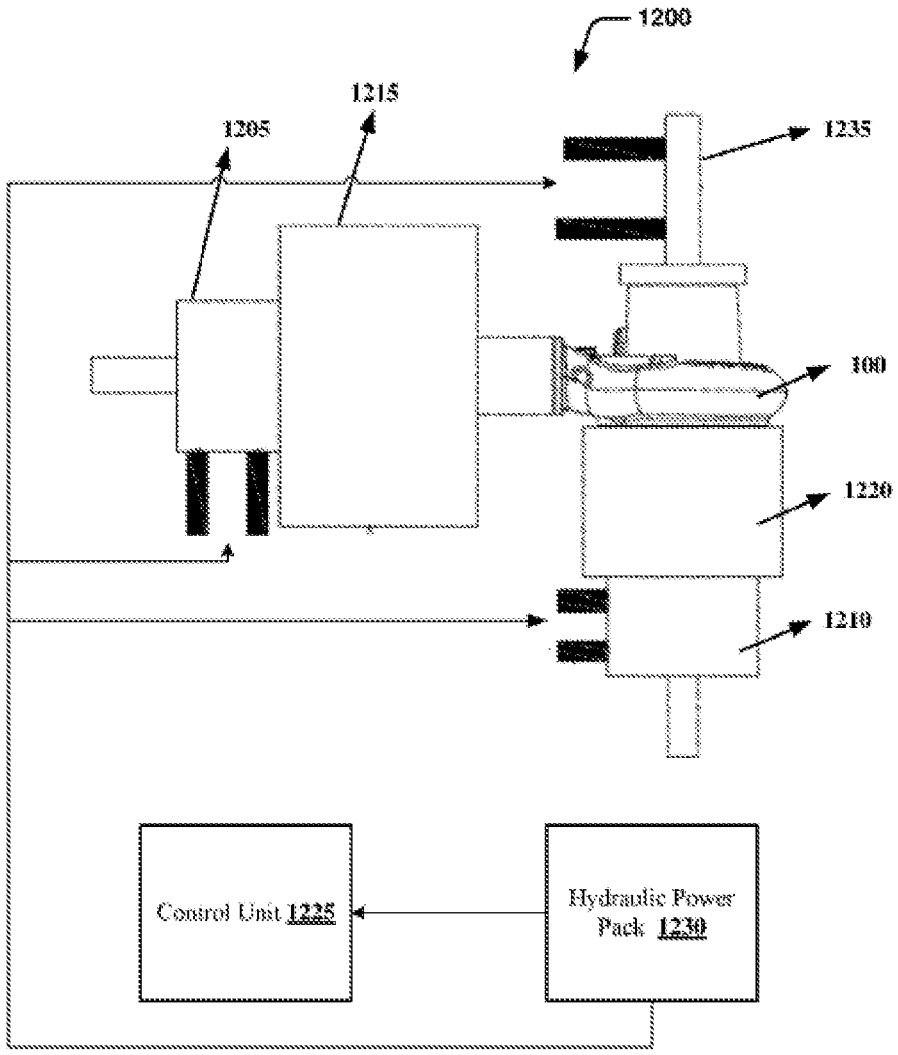
FIG. 12 shows an abrasive flow apparatus in the form of a machine system, in accordance with an embodiment of the present subject matter.

FIG. 12 shows an abrasive flow apparatus in the form of a machine system 1200, in accordance with an embodiment of the present subject matter. As mentioned previously, the method 200 is implemented using the abrasive flow apparatus 1200, in accordance with an embodiment of the present subject matter. In an embodiment, the abrasive flow apparatus 1200 comprises a tooling, for example, mechanical jig (not shown in the FIG. 12) to hold the component 100 with an irregularly shaped internal passage 115 and two cylinders comprising a first cylinder 1205 and a second cylinder 1210. The apparatus 1200 further comprises a first abrasive cylinder or a first slurry chamber 1215 for containing abrasive slurry, a second abrasive cylinder or a second slurry chamber 1220 for containing the abrasive slurry, a control unit 1225, a hydraulic power pack 1230, a locking cylinder 1235 and a diaphragm fixture (not shown in the FIG. 12).

In an aspect, the first slurry chamber 1215 is arranged on one side of the component 100, and the second slurry chamber 1220 is arranged on other side of the component 100. For example, the component 100 is a turbocharger compressor housing 100. As previously discussed with respect to FIG. 1, the turbocharger compressor housing 100 may include two ports 105, 110, where a first port 105 of the turbocharger compressor housing 100 is connected to the first slurry chamber 1215 and the second port 110 of the turbocharger compressor housing 100 is connected to the second slurry chamber 1220. Further, in an embodiment, the second port 110 may be fixed securely with the diaphragm fixture. For example, the diaphragm fixture may be of circular shaped, and the geometry of the diaphragm fixture may correspond to the geometry of the second port 110.

Although the apparatus in the form of the machine system 1200 shown in the FIG. 12 includes hydraulic cylinders 1205, 1210, it is to be understood that any other cylinders such as pneumatic cylinders can be used. In an example, the first cylinder 1205 and the second cylinder 1210 are hydraulic cylinders. In another example, the first cylinder 1205 and the second cylinder 1210 are pneumatic cylinders. The hydraulic fluid or the pneumatic gas pressure may be applied to the abrasive slurry present in the first slurry chamber 1215 and the second slurry chamber 1220. The apparatus in the form of the machine system 1200 further comprises a hydraulic fluid or pneumatic gas supply port for receiving a hydraulic fluid or pneumatic gas supply. In an embodiment, the first cylinder 1205 and second cylinder 1210 are driven through the hydraulic power pack 1230 to give the linear movement to push the abrasive slurry present in the first slurry chamber 1215 during the forward pumping half-cycle and the second slurry chamber 1220 during the reverse pumping half-cycle through the irregularly shaped internal passage surface 115 of the turbocharger compressor housing 100.

In an embodiment, the first cylinder 1205 may be operationally connected to the first slurry chamber 1215 and disposed to enable pressurizing the first slurry chamber 1215 to enable pumping of the abrasive slurry through the first port 105 of the turbocharger compressor housing 100 at a predetermined controlled pressure during a forward pumping cycle, this being the first half-cycle of the process cycle. Further, the second cylinder 1210 may be operationally connected to the second slurry chamber 1220 and disposed to enable pressurizing the second slurry chamber 1220 to enable pumping of the abrasive slurry through the second port 110 of the turbocharger compressor housing 100 at the predetermined controlled pressure during a reverse pumping cycle, this being the second half-cycle of the process cycle. In an aspect, the first cylinder 1205 is positioned perpendicular to the second cylinder 1210. In an aspect, the predetermined controlled pressure is in the range from about 25 bar to 35 bar.

The abrasive flow apparatus in the form of the machine system 1200 further comprises a flow sensor, a pressure sensor, a servo valve, and one or more limit switches (not shown in the FIG. 12) for enabling the control of the pressure and flow of the abrasive slurry from the first slurry chamber 1215 to the second slurry chamber 1220 and vice versa.

In an embodiment, the abrasive flow apparatus in the form of the machine system 1200 comprises the control unit 1225, for example, PLC unit to control the pressure and flow of the abrasive slurry from the first slurry chamber 1215 to the second slurry chamber 1220 in the first half-cycle of the process cycle and the reverse flow from the second slurry chamber 1220 to the first slurry chamber 1215 in the second half-cycle of the process cycle.

In operation, the abrasive slurry is periodically injected from the first slurry chamber 1215 to the second slurry chamber 1220 and vice versa through the volute area 115 of the turbocharger compressor housing 100 by driving the first cylinder 1205 and the second cylinder 1210 using the hydraulic power pack 1230. In an embodiment, the abrasive slurry comprises abrasive particles having a size in the range of about 40 μm to about 60 μm, and a slurry medium. The volume fraction of the abrasive particles in the slurry medium is about 40% to about 50%.

During a first half of process cycle, the abrasive slurry is injected from the first slurry chamber 1215 to the second slurry chamber 1220 through the volute area 115. During a second half of the process cycle, the abrasive slurry injected back from the second slurry chamber 1220 to the first slurry chamber 1215 through the volute area 115. Further, the injection of the abrasive slurry may be performed for a predefined number of process cycles at predetermined time versus pressure changes to obtain the component having a final average surface roughness of less than about 3.0 μm. In an embodiment, the diaphragm fixture is adapted to regulate the flow of the abrasive slurry through the irregular shaped passage 115 during the back and forth pumping of the abrasive slurry.

Figure 13:
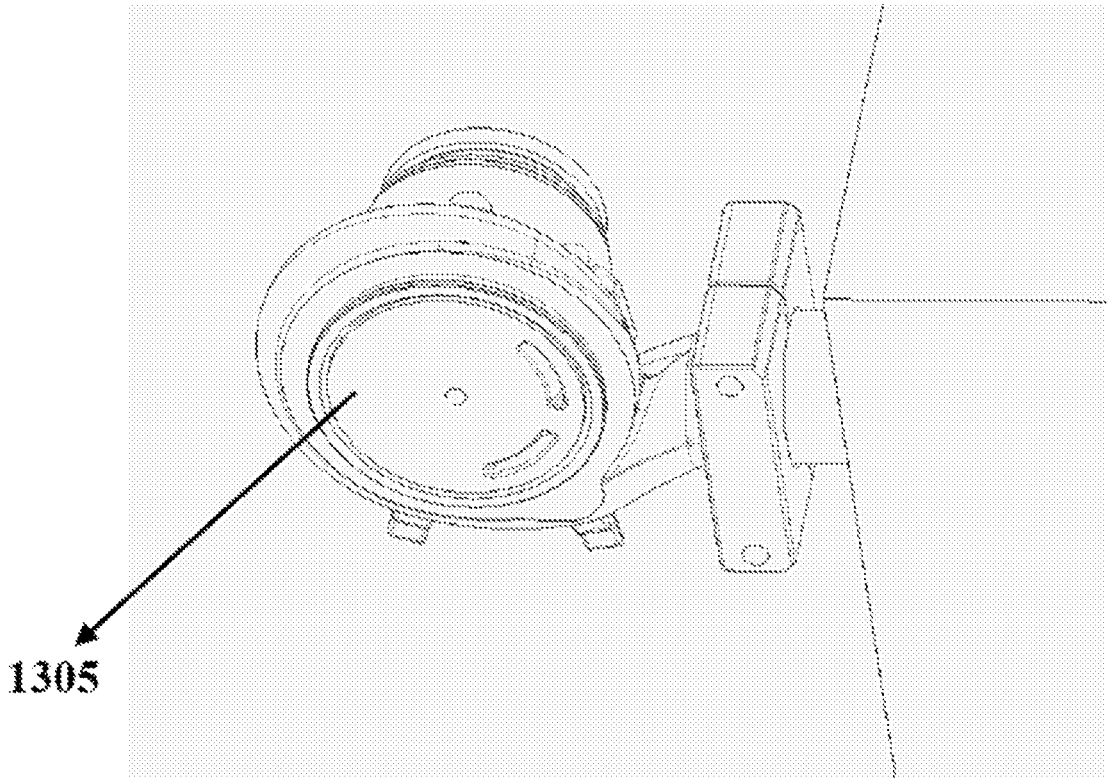
FIG. 13 shows turbocharger compressor housing fixed with a diaphragm fixture, in accordance with an embodiment of the present subject matter.

FIG. 13 shows turbocharger compressor housing fixed with a diaphragm fixture, in accordance with an embodiment of the present subject matter. As mentioned previously, the first port 105 is connected to the first slurry chamber 1215 and the second port 110 is connected to the second slurry chamber 1220. Further, the diaphragm fixture 1305 is fixed to the second port 110 of the turbocharger compressor housing 100, as shown in the FIG. 13. In an aspect, the geometry of the diaphragm fixture 1305 corresponds to geometry of the second port 110 of the turbocharger compressor housing 100. Further, the diaphragm fixture 1305 is made from one of: steel, Teflon, and nylon. The diaphragm fixture 1305 is designed in such a way that a tongue position and a diffusion area of the turbocharge compressor housing 100 are not damaged. The position of the tongue and the diffusion area are known specifically to practitioners of the art. The diaphragm fixture 1305 ensures that the abrasive slurry passes predominantly through the irregular shaped internal passage 115 and thereby uniform finish is obtained. Thus, the diaphragm fixture 1305 aids in improving the overall performance of the abrasive slurry machining of the turbocharge compressor volute surface.

The diaphragm fixture 1305 is of a circular shaped, and comprises at least one slot formed around a portion of a circumference of the diaphragm fixture 1305. For example, the position of the slot is at a predetermined distance from the tongue portion. Different configurations of the diaphragm fixture 1305 are shown in FIG. 14*a* to FIG. 14*b*.

Figure 14A:
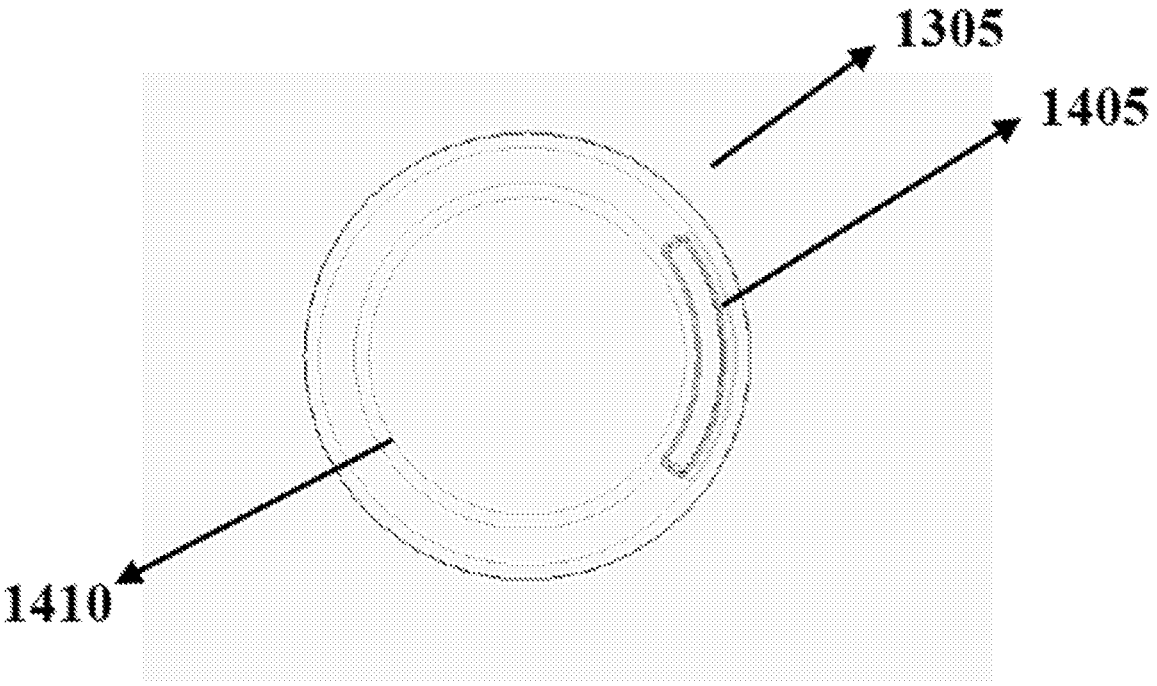
FIG. 14*a* to FIG. 14*d* show different configurations of the diaphragm fixture of the FIG. 13, which can be fixed to the turbocharger compressor housing, in accordance with an embodiment of the present subject matter.

In an embodiment, the diaphragm fixture 1305 comprises a single slot 1405 as shown in the FIG. 14*a*. Further, width of the slot 1405 may vary along a length of the slot 1405, and the width of the slot 1405 may be about 3 mm to about 5 mm. In addition, the diaphragm fixture 1305 comprises an O-ring 1410 as shown in the FIG. 14*a*. For example, the O-ring 1410 is made of rubber.

Figure 14B:
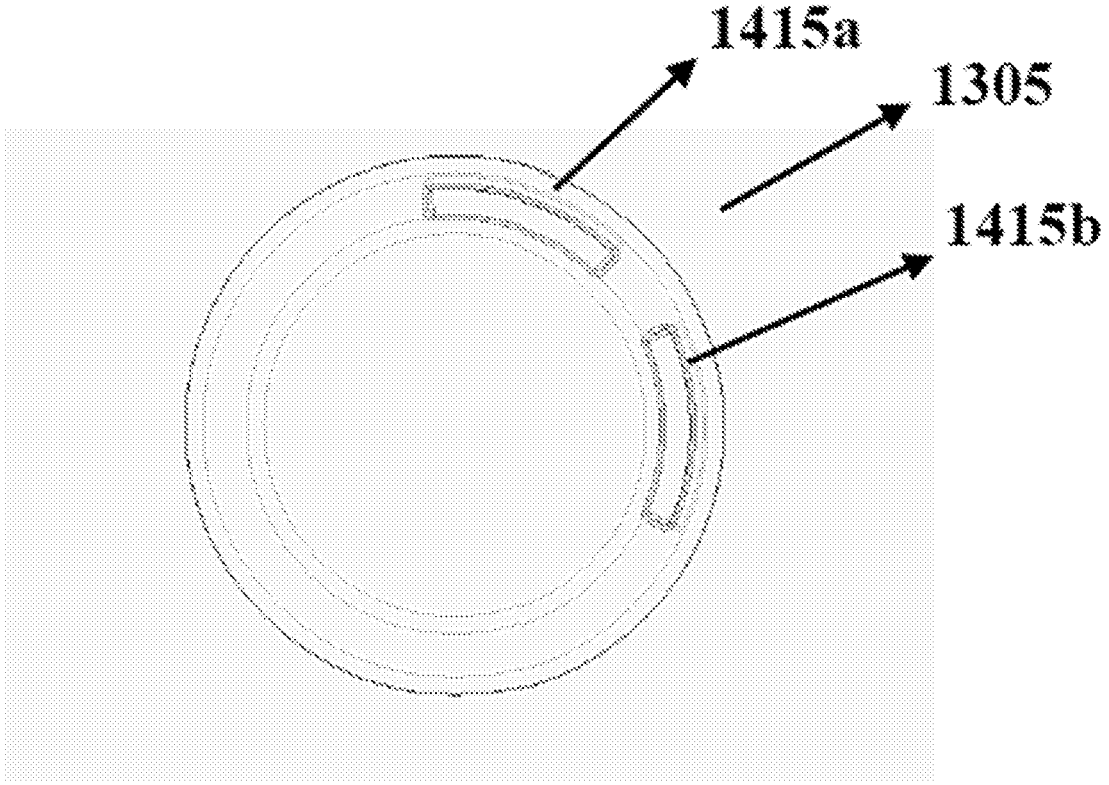

In another embodiment, the diaphragm fixture 1305 comprises two slots 1415*a*, 1415*b* formed around a circumference of the diaphragm fixture 1305 as shown in the FIG. 14*b*.

Figure 14C:
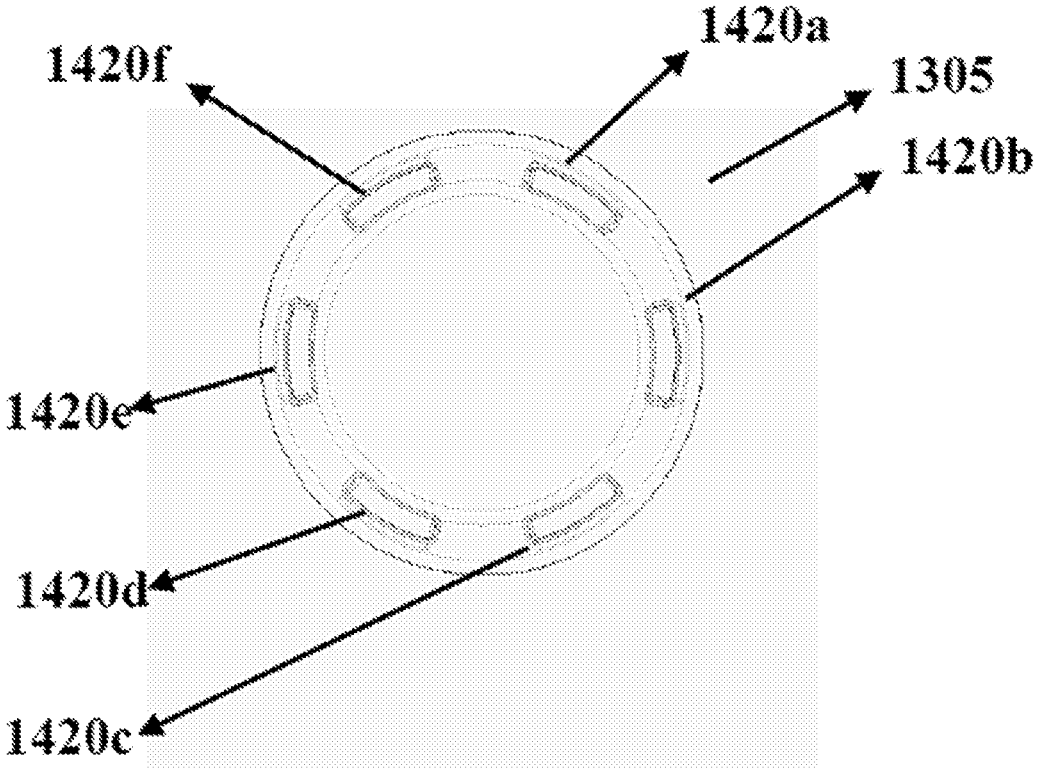

Further, in another embodiment, the diaphragm fixture 1305 may comprise multiple slots (1420*a*, 1420*b*, 1420*c*, 1420*d*, 1420*e*, 14200 as shown in the FIG. 14*c*.

Figure 14D:
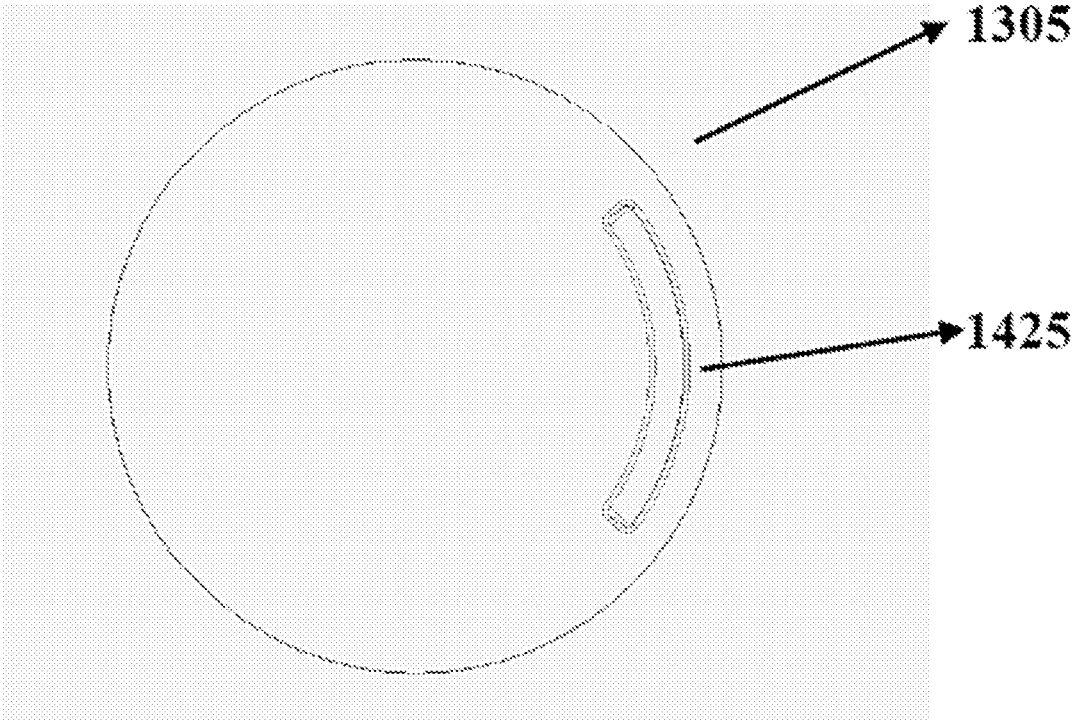

Furthermore, in another embodiment, the diaphragm fixture 1305 may comprise multiple holes 1425, for example, 64 holes, around a circumference of the diaphragm fixture 1305 as shown in the FIG. 14*d*.

As previously discussed, the diaphragm fixture is adapted to regulate the flow of the abrasive slurry through the irregular shaped passage during the back and forth pumping of the abrasive slurry at predetermined time versus pressure changes for a predefined number of cycles.

By employing the method 200 of the present subject matter using the abrasive flow machining apparatus, components like the turbocharger compressor housing 100 may be machined within 6 minutes to 10 minutes, while obtaining the average surface roughness of less than 3 μm. Further, engine efficiency is improved and emission is reduced by employing the turbocharger compressor housing obtained by the present subject matter. For example, the engine efficiency is improved by 10% and the engine emission is reduced by 10%.

Although embodiments for machining an internal passage, such as volute area, of a component, such as a turbocharger compressor housing, have been described in language specific to structural features and/or methods, it is to be understood that the appended claims are not necessarily limited to the specific features or the methods described. Rather, the specific features and methods are disclosed as example embodiments for implementing the claimed subject matter.

I claim:

1. A method for machining a component with an internal passage, the method comprising:

periodically injecting abrasive slurry back and forth through the internal passage at a pressure ranging from about 25 bar to about 35 bar, wherein the abrasive slurry comprises a mixture of:

abrasive particles having a size in a range from about 40 μm to about 60 μm; and a slurry medium, wherein a volume fraction of the abrasive particles in the slurry medium is about 40% to about 50%; and performing the injection for a predefined number of process cycles at predetermined time-versus-pressure changes to obtain the component having a final average surface roughness of less than about 3.0 μm.

2. The method as claimed in claim 1, wherein the method comprises:

determining an initial average surface roughness of the component; and based on at least one of the initial average surface roughness and the final average surface roughness of the component, preparing the abrasive slurry by determining configuration of the abrasive particles, and selecting the slurry medium.

3. The method as claimed in claim 1, wherein the slurry medium has characteristics from viscous flowing to semi-solid.

4. The method as claimed in claim 1, wherein the injecting of the abrasive slurry back and forth for the predefined number of process cycles at the predetermined time versus pressure changes comprising:

applying the pressure in the form of one of: sinusoidal, triangular, and pulse for a first predetermined time and applying an impulse pressure for a second predetermined time, during each half-cycle of each process cycle.

5. The method as claimed in claim 4, wherein the predetermined time is a total time taken for performing:

injecting the abrasive slurry from a first slurry chamber to a second slurry chamber through the internal passage during a forward movement of the abrasive slurry, this forming a first half cycle of a process cycle; and injecting the abrasive slurry from the second slurry chamber to the first slurry chamber through the internal passage during a reverse movement of the abrasive slurry, this forming a second half cycle of the process cycle.

6. The method as claimed in claim 4, wherein the pressure has a peak value in a range from about 20 bar to about 40 bar, and the predetermined time is in a range from about 2 seconds to about 10 seconds.

7. The method as claimed in claim 5, wherein the injecting of the abrasive slurry back and forth is carried out by a pair of cylinders, and wherein one cylinder of the pair of cylinders is adapted to pump the abrasive slurry from the first slurry chamber to the second slurry chamber, and another cylinder of the pair of cylinders is adapted to pump the abrasive slurry from the second slurry chamber to the first slurry chamber.

8. The method as claimed in claim 6, wherein the impulse pressure has a peak value of about 1.4 to 1.5 times the peak value of the pressure being applied during the first predetermined time, and wherein the second predetermined time is in a range from about 50 micro seconds to about 200 micro seconds.

9. The method as claimed claim 1, wherein the pressure is 35 bar, the size of the abrasive particles is 40 μm, and the volume fraction of the abrasive particles is 50%.

10. The method as claimed in claim 1, wherein the slurry medium is selected from a group consisting of: aluminum oxide, boron carbide, silicon carbide, and titanium carbide.

11. The method as claimed in claim 1, wherein the internal passage is irregulariy shaped and the turbocharger compressor housing is made of aluminum alloy.

12. An abrasive flow apparatus in the form of a machine system for pumping abrasive slurry through a component with an internal passage, the abrasive flow apparatus in the form of the machine system (1200) comprising:

a holder to hold the component;

a first slurry chamber, wherein the first slurry chamber is connected to a first port of the component;

a second slurry chamber, wherein the second slurry chamber is connected to a second port of the component;

a first cylinder operationally connected to the first slurry chamber and disposed to enable pressurizing the first slurry chamber to enable pumping of the abrasive slurry through the first port of the component at a predetermined controlled pressure during a forward pumping cycle, this being a first half-cycle of a process cycle;

a second cylinder operationally connected to the second slurry chamber and disposed to enable pressurizing the second slurry chamber to enable pumping of the abrasive slurry through the second port of the component at the predetermined controlled pressure during a reverse pumping cycle, this being a second half-cycle of the process cycle; and a diaphragm fixture securely fixed to the second port of the component, wherein the diaphragm fixture has a geometry corresponding to geometry of the second port of the component to regulate the flow of the abrasive slurry through the internal passage during back and forth pumping of the abrasive slurry at predetermined time-versus-pressure changes for a predefined number of process cycles.

13. The abrasive flow apparatus in the form of the machine system as claimed in claim 12, wherein the diaphragm fixture is of a circular shape, and comprises at least one slot formed around a portion of a circumference of the diaphragm fixture.

14. The abrasive flow apparatus in the form of the machine system as claimed in claim 12, wherein the diaphragm fixture comprises a slot and a width of the slot varies along a length of the slot.

15. The abrasive flow apparatus in the form of the machine system as claimed in claim 12, wherein the diaphragm fixture is made from one of: steel, Teflon, and nylon.

16. The abrasive flow apparatus in the form of the machine system as claimed in claim 12, wherein the abrasive slurry comprises a mixture of:

abrasive particles having a size in a range of about 40 μm to about 60 μm; and a slurry medium, wherein a volume fraction of the abrasive particles in the slurry medium is about 40% to about 50%.

17. The abrasive flow apparatus in the form of a machine system as claimed in claim 12 comprises a control unit to control the pressure and flow of the abrasive slurry from the first slurry chamber to the second slurry chamber in the first half-cycle of the process cycle and the reverse flow from the second slurry chamber to the first slurry chamber in the second half-cycle of the process cycle.

18. The abrasive flow apparatus in the form of a machine system as claimed in claim 17 comprises a flow sensor, a pressure sensor, a servo valve, and one or more limit switches for enabling control of the pressure and flow of the abrasive slurry from the first slurry chamber to the second slurry chamber and vice versa.

19. The abrasive flow apparatus in the form of a machine system as claimed in claim 12, wherein the predetermined controlled pressure is in a range from about 25 bar to 35 bar.

* * * * *